United States Patent [19]

Belvederi

[11] Patent Number: 4,848,371

[45] Date of Patent: Jul. 18, 1989

[54] FILTER ASSEMBLY MACHINE

[75] Inventor: Bruno Belvederi, S. Martino di Monte S. Pietro, Italy

[73] Assignee: G. D Societa Per Azioni, Bologna, Italy

[21] Appl. No.: 198,002

[22] Filed: May 24, 1988

[30] Foreign Application Priority Data

Jun. 8, 1987 [IT] Italy ..... 3509 A/87

[51] Int. Cl.[4] ..... A24C 5/10; A24C 5/35; A24C 5/47; A24C 5/58

[52] U.S. Cl. ..... 131/94

[58] Field of Search ..... 131/94, 281

[56] References Cited

U.S. PATENT DOCUMENTS 4,745,932 5/1988 Mattei et al. ..... 131/94

FOREIGN PATENT DOCUMENTS 0682379 2/1965 Italy ..... 131/94

0783236 9/1950 United Kingdom ..... 131/94

*Primary Examiner*—Vincent Millin

*Assistant Examiner*—C. Crosby

*Attorney, Agent, or Firm*—Marshall, O'Toole, Gerstein, Murray & Bicknell

[57] ABSTRACT

A filter assembly machine on which a feed roller successively feeds groups consisting of two cigarettes separated by a double filter, and respective adhesive-coated connecting strips on to a roller comprising a cylindrical body having a number of equally-spaced peripheral cavities each housing a continuously-rotating roller defining, together with the respective cavity, an arched rolling channel approximately equal in size to the diameter of a group; each roller having two diametrically-opposed suction seats inside one of which a group is fed by the aforementioned feed roller. As the roller turns, the group expelled from the respective seat travels at least once along the rolling channel in such a manner as to be wrapped inside respective strip and, each time it comes out of the rolling channel, is fed into the opposite seat to that from which it was expelled; each group connected by strip subsequently being fed on to a pick-off roller.

5 Claims, 2 Drawing Sheets

FIG. 2
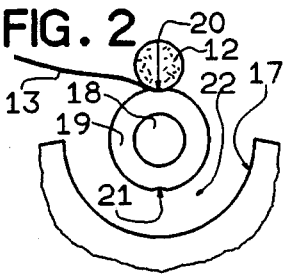
FIG. 3
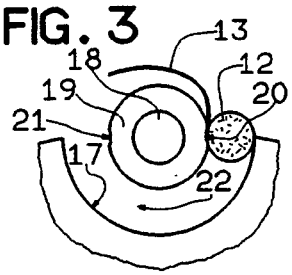
FIG. 4
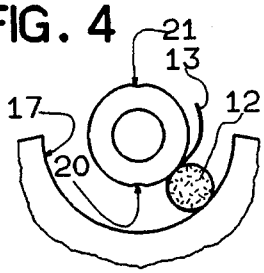
FIG. 5
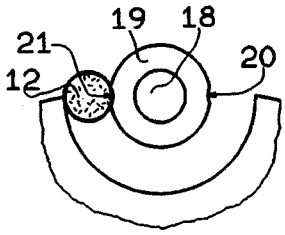
FIG. 6
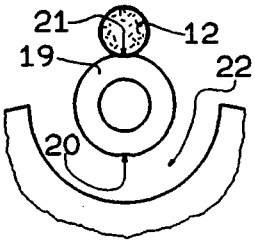
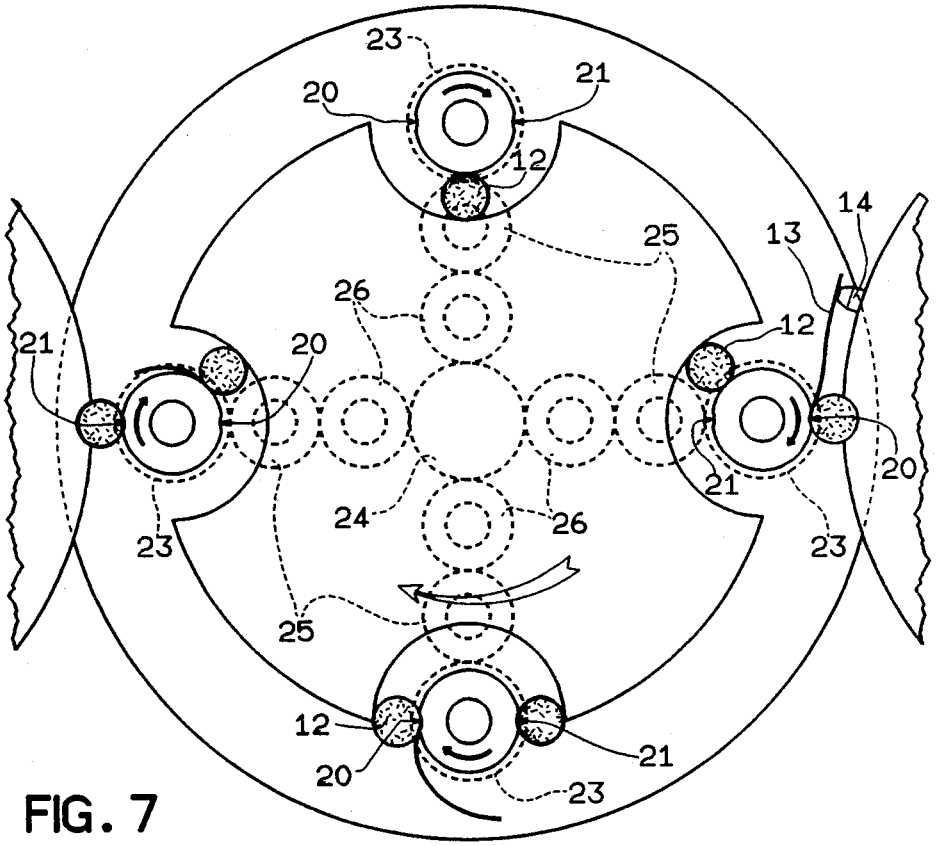
FIG. 7

FILTER ASSEMBLY MACHINE

BACKGROUND OF THE INVENTION

The present invention relates to a filter assembly machine.

On known so-called filter assembly machines, the filters are connected to the cigarettes using adhesive-coated paper strips wrapped around groups of two coaxial cigarette lengths separated by a filter twice the length of that of a finished cigarette.

The said strips are usually wrapped around the said groups as the latter travel over a roller conveyor, on which they are retained by suction inside seats formed on the peripheral surface of the roller. An arched plate coaxial with the said roller, and separated from the cylindrical surface of the same by a distance approximately equal to the cigarette diameter, provides for expelling the said groups successively and by friction from the respective said seats, and rolling them along the surface of the roller into the next seat on the same. As it rolls along the surface of the said roller, each group is wrapped inside a connecting strip placed beforehand in the vicinity of the group contacting the surface of the conveyor roller. Continual improvement to the output speed of cigarette manufacturing machines has led to the design of increasingly fast filter assembly machines, to enable the formation of cigarette manufacturing lines on which the output of each manufacturing machine is connected to the input of a respective filter assembly machine. Such improvement to the aforementioned known filter assembly machines has enabled extremely high-speed output which can no longer be acclerated by straightforward mechanical means alone, without subjecting the cigarettes to unacceptable stress, particularly at the rolling stage. In fact, any further increase in the rolling speed of double cigarettes as described above would inevitably result in tobacco leakage from the open ends of the cigarette lengths.

SUMMARY OF THE INVENTION

The aim of the present invention is to provide a filter assembly machine enabling an increase in current output speed, while at the same time maintaining a safe rolling speed, thus preventing tobacco leakage from the open ends of the cigarette lengths.

With this aim in view, according to the present invention, there is provided a filter assembly machine comprising a feed roller for supplying groups of two coaxial cigarette lengths separated by a double filter; a rolling unit for joining the said cigarette lengths and the said double filter by means of an adhesive-coated strip wrapped around the said double filter and the ends of the said cigarette lengths; and a pick-off roller for removing the said groups off the said rolling unit; the said rolling unit comprising a supporting body designed to turn about an axis parallel with the axes of the said feed and pickoff rollers; characterised by the fact that the said rolling unit comprises a number of equally-spaced arched cavities formed on the periphery of the said supporting body, the axes of the said cavities being parallel with the rotation axis of the said supporting body; and a number of equally-spaced supporting elements for successively receiving the said groups and the said strips from the said feed roller, and feeding the same along a given route; each said supporting element being housed coaxially and in rotary manner inside a said cavity and defining, together with the same, a rolling channel approximately equal in size to the diameter of a said group; actuating means being provided for continuously turning the said supporting elements about their own axes during rotation of the said supporting body; at least two equally-spaced grooves parallel with the axis of the respective said cavity being formed on the peripheral surface of each said supporting element, said grooves being designed to receive the said groups off the said feed roller, and feed the same into a said rolling channel during rotation of the said supporting element about its own axis.

BRIEF DESCRIPTION OF THE DRAWINGS

A preferred non-limiting embodiment of the present invention will be described by way of example with reference to the accompanying drawings in which:

FIGS. 2 to 6 show larger-scale views of a detail in FIG. 1 in five different operating positions;

FIG. 7 shows a schematic view of a further embodiment of the filter assembly machine according to the present invention.

DETAILED DESCRIPTION OF THE INVENTION

Figure 1:
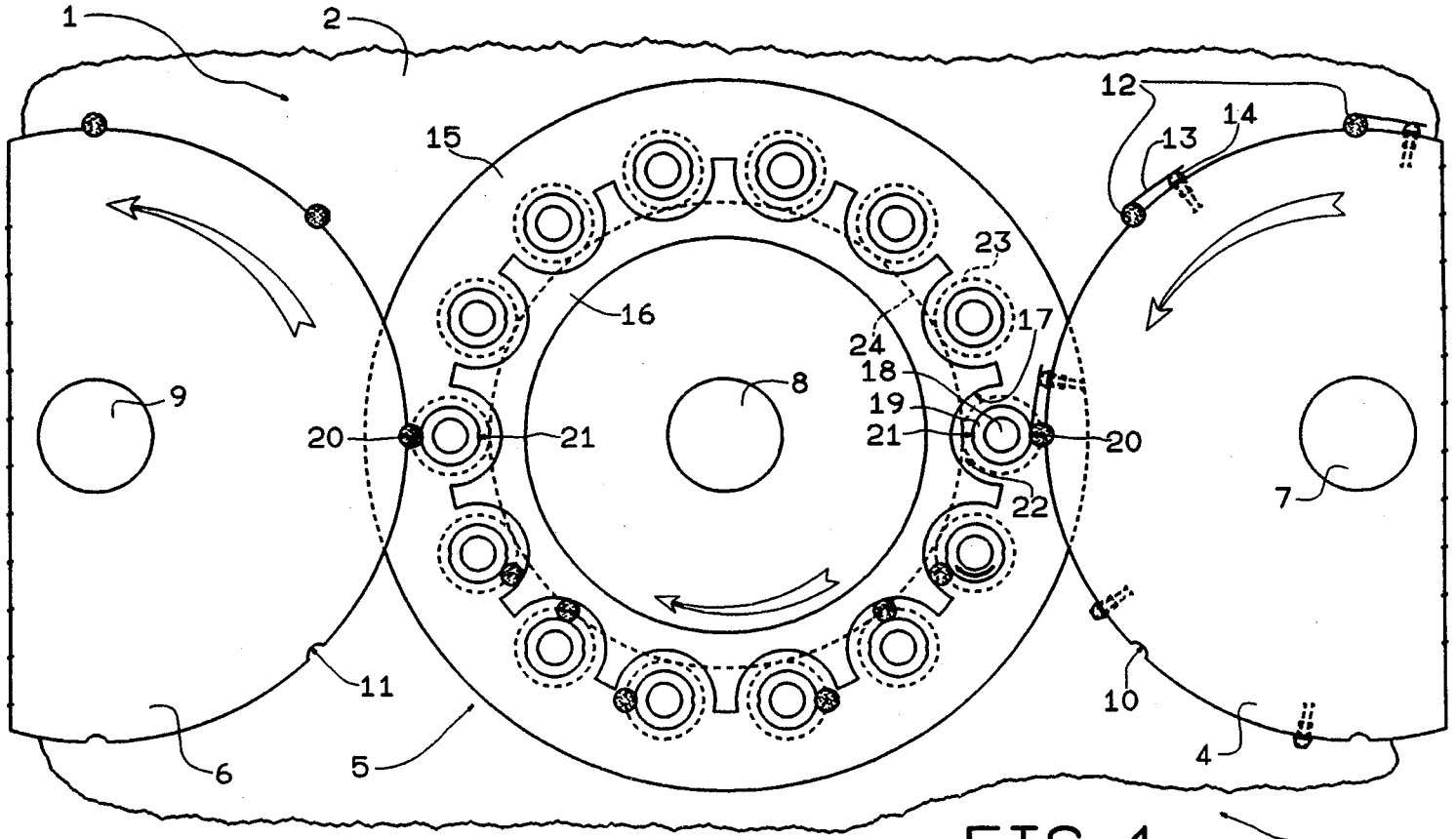
FIG. 1 shows a schematic view of part of a filter assembly machine in accordance with the teachings of the present invention.

Number 1 in FIG. 1 indicates a device for assembling cigarette filters and supported on a vertical wall 2 of a filter assembly machine indicated as a whole by 3.

Device 1 comprises three horizontal rollers 4, 5 and 6. Rollers 4 and 5 are substantially tangent to each other and supported on respective shafts 7 and 8 turning anticlockwise and clockwise respectively. Roller 5 is also substantially tangent to roller 6, which is fitted on an anticlockwise shaft 9.

Rollers 4 and 6, hereinafter also referred to respectively as feed and pick-off rollers, present a number of respective peripheral grooves 10 and 11 parallel with the axes of shafts 7 and 9 and defining seats for receiving and retaining a respective group 12 consisting of two coaxial cigarette lengths separated by a filter twice the length of that of a finished cigarette.

From operating stations not shown, groups 12 are fed in known manner into respective grooves 10 on roller 4, together with a respective adhesive-coated strip 13 also fed in known manner and arranged with its downstream end (in relation to the rotation direction of roller 4) resting on the mid outer peripheral portion of respective group 12, and the other end resting on a suction retaining element 14 on the periphery of roller 4 immediately upstream from respective groove 10.

Roller 5 constitutes a rolling unit for connecting each of the said cigarette lengths and the said filter in each group 12, by wrapping the said filter and the adjacent ends of the said cigarette lengths in an adhesive-coated strip 13.

As shown in FIG. 1, roller 5 comprises a cylindrical element 15 fitted on to shaft 8 and supporting coaxially and in rigid manner a conveying and rolling element 16 substantially consisting of a cylindrical supporting body having a number of equally-spaced, semicylindrical, peripheral cavities 17 with their respective concave sides facing element 16.

Inside each cavity 17, cylindrical element 15 supports in rotary manner, via shaft 18 parallel with shaft 8, a supporting element 19 consisting of a roller coaxial with respective cavity 17 and having two diametrically-opposed peripheral grooves 20 and 21 defining two suction seats for receiving and retaining a group 12. Each roller 19 and respective cavity 17 present knurled surfaces, and the diameter of each roller 19 is such as to define, between it and respective cavity 17, a substantially semicircular passage 22, also referred to as a rolling channel and approximately equal in size to the diameter of the said filter and cigarette lengths in each group 12.

To one end of each shaft 18, outside cavity 17, there is fitted a gear 23 meshing with a fixed gear 24 coaxial with shaft 8. By virtue of gears 23 meshing with gear 24, rotation of roller 5 causes rollers 19 to turn clockwise about their respective axes at constant speed. Gears 23 and 24, hereinafter also referred to as the actuating means of rollers 19, are sized so that, when roller 5 is turned, each roller 19 makes three complete turns about its axis as it travels between the points of substantial tangency between roller 5 and rollers 4 and 6.

In actual use, groups 12 and strips 13 partially adhering to the same are transferred successively in known manner from seats 10 on roller 4 to seats 20 on rollers 19, which seats 20 are arranged facing outwards of roller 5 (FIG. 2) when groups 12 are transferred from one roller to the other.

Further rotation of roller 5 causes roller 19 housing group 12 inside seat 20 to turn clockwise into the FIG. 3 position, wherein group 12 engages rolling channel 22 and, upon contacting the surface of cavity 17, is expelled from seat 20 and rolled between the knurled surfaces of roller 19 and cavity 17 (FIG. 4). As it does, strip 13, which formerly had only one edge adhering to group 12, is wrapped about group 12 so as to connect the cigarette lengths and filter composing the same. In the FIG. 5 position, at the outlet of rolling channel 22, group 12 occupies seat 21 opposite seat 20. Further 90° rotation of roller 19 brings group 12 into the FIG. 6 position, wherein it is arranged exactly as in FIG. 1, but housed inside seat 21 instead of seat 20.

As each roller 19 travels between the points of substantial tangency with rollers 4 and 6, i.e. 180° rotation of roller 5, appropriate sizing of gears 23 and 24 causes it to turn about its axis, as described above, a given whole number of times (twice in the example shown) so as to enable repeat rolling and firm connection of the elements in group 12. At each rolling operation, each group 12 is transferred from the starting seat 20 or 21 to the diametrically-opposite seat on roller 19. When each roller 19 reaches the point of substantial tangency between rollers 5 and 6, seat 20 containing group 12 wrapped inside strip 13 is arranged facing outwards of roller 5, and group 12 is transferred into a seat 11 on roller 6 by which it is fed to further operating stations (not shown). As groups 12 are transferred by roller 5 between rollers 4 and 6, they may thus be rolled inside channels 22 at a lower speed than on known filter assembly machines. In fact, on known machines, the traveling speed of groups 12 during rolling is extremely high, by virtue of it being equal to half the speed of the roller on which the rolling operation is performed. On the filter assembly machine according to the present invention, however, the said traveling speed may be considerably reduced, by virtue of it depending, not on the speed of roller 5, but on that of rollers 19 inside cavities 17; which reduction may be made by appropriately sizing gears 23 and 24.

In the FIG. 7 embodiment, actuating means consisting of two idle gears 25 and 26 are inserted between each pair of gears 23 and 24, which are sized in such a manner that one complete turn of roller 5 corresponds to a complete turn of each roller 19.

A complete rolling cycle of one group 12 will now be described with reference to FIG. 7, commencing from when the said group 12, complete with extended strip 13, is fed inside seat 20 at the point of tangency between rollers 4 and 5. For the sake of simplicity, FIG. 7 shows one roller 19 in four different operating positions at 90° to one another. Subsequent to a first quarter turn of rollers 5 and 19, commencing from the said point of tangency, group 12 is located at the inlet of rolling channel 22. At the point of substantial tangency between rollers 5 and 6, seat 20 has moved into the position formerly occupied by seat 21, and group 12 is located halfway between the inlet of channel 22 and seat 20. Subsequent to a third quarter turn of rollers 5 and 19, seat 20 is located at the outlet, and group 12 halfway along channel 22. Subsequent to a fourth quarter turn of roller 5, seat 20 has moved back to its former position, for receiving a further group 12, and the first group 12 is located halfway between the outlet of channel 22 and seat 21. Subsequent to further 90° rotation of rollers 5 and 19, the rolled group 12 moves into seat 21 at the outlet of channel 22, from which, at the end of the next quarter turn of roller 5, it is fed into a seat 11 on pick-off roller 6. The above operations are obviously repeated for each group 12 fed by roller 4 into seat 20 on roller 19.

To those skilled in the art it will be clear that changes may be made to the filter assembly machine as described and illustrated herein without, however, departing from the scope of the present invention.

For example, the gearing comprising gears 23 and 24, and possibly also gears 25 and 26, may be replaced by any type of gearing designed to turn rollers 19 in the required direction and at the required speed, alongside rotation of roller 5. Also, rollers 19 may present any number of suction seats other than the two considered in the example shown, and channels 22 may present other than a 180° arc. By appropriately sizing gears 23 and 24, and possibly also gears 25 and 26, the rotation speed of rollers 19 may obviously be regulated in such a manner as to turn rollers 19 any number of times between the said points of tangency between roller 5 and rollers 4 and 6, and so regulate the rolling speed of groups 12 as required.

I claim:

1. A filter assembly machine (3) comprising a feed roller (4) for supplying groups (12) consisting of two coaxial cigarette lengths separated by a double filter; a rolling unit (5) for joining the said cigarette lengths and the said double filter by means of an adhesive-coated strip (13) wrapped around the said double filter and the ends of the said cigarette lengths; and a pick-off roller (6) for removing the said groups (12) off the said rolling unit (5); the said rolling unit (5) comprising a supporting body (16) designed to turn about an axis parallel with the axes of the said feed and pick-off rollers (4, 6); characterised by the fact that the said rolling unit (5) comprises a number of equally-spaced arched cavities (17) formed on the periphery of the said supporting body (16), the axes of the said cavities (17) being parallel with the rotation axis of the said supporting body (16); and a number of equally-spaced supporting elements (19) for successively receiving the said groups (12) and the said strips (13) from the said feed roller (4), and feeding the same along a given route; each said supporting element (19) being housed coaxially and in rotary manner inside a said cavity (17) and defining, together with the same, a rolling channel (22) approximately equal in size to the diameter of a said group (12); actuating means (23–26) being provided for continuously turning the said supporting elements (19) about their own axes during rotation of the said supporting body (16); at least two equallyspaced grooves (20, 21) parallel with the axis of the respective said cavity (17) being formed on the peripheral surface of each said supporting element (19), said grooves (20, 21) being designed to receive the said groups (12) off the said feed roller (4), and feed the same into a said rolling channel (22) during rotation of the said supporting element (19) about its own axis.

2. A filter assembly machine as claimed in claim 1, characterised by the fact that each said supporting element consists of a roller (19) having two said diametricallyopposed grooves (20, 21); in use, one said groove (20 or 21) substantially facing outwards of the said supporting body (16) upon the respective said roller (19) reaching the points of substantial tangency between the said rolling unit (5) and the said feed and pick-off rollers (4, 6).

3. A filter assembly machine as claimed in claim 1, characterised by the fact that the said actuating means comprise a first gear (23) integral and coaxial with each said supporting element (19), and a second fixed gear (24) coaxial with the said supporting body (16) and meshing with each said first gear (23).

4. A filter assembly machine as claimed in claim 1, characterised by the fact that each said group (12) fed by the said feed roller (4) into a said groove (20 or 21) on the said supporting element (19) is expelled, in use, from the said groove (20 or 21) as it enters the said rolling channel (22); is rolled along the said rolling channel (22) as the said supporting element (19) turns about its own axis; and is fed into a different groove (20 or 21) on the said supporting element (19) at the outlet of the said rolling channel (22).

5. A filter assembly machine as claimed in claim 1, characterised by the fact that the speed of the said supporting elements (19) is the same as that of the said supporting body (16).

* * * * *